US005586869A

United States Patent [19]

Benckert et al.

[11] Patent Number: 5,586,869

[45] Date of Patent: Dec. 24, 1996

[54] INITIAL PRESSURE GOVERNOR FOR A VARIABLE DISPLACEMENT PUMP

[75] Inventors: Hartmut Benckert, Sielmingen; Werner Muenzenmaier, Nuertingen, both of Germany

[73] Assignee: Putzmeister-Werk Maschinenfabrik GmbH, Germany

[21] Appl. No.: 244,917

[22] PCT Filed: Dec. 12, 1992

[86] PCT No.: PCT/EP92/02880

§ 371 Date: Jun. 10, 1994

§ 102(e) Date: Jun. 10, 1994

[87] PCT Pub. No.: WO93/12342

PCT Pub. Date: Jun. 24, 1993

[30] Foreign Application Priority Data

Dec. 13, 1991 [DE] Germany ..... 41 41 108.0

[51] Int. Cl.[6] ..... F04B 49/02

[52] U.S. Cl. ..... 417/218; 60/452

[58] Field of Search ..... 417/218; 60/450, 60/452

[56] References Cited

U.S. PATENT DOCUMENTS 5,173,031 12/1992 Nonnenmacher et al. ..... 417/218

FOREIGN PATENT DOCUMENTS 0078861 11/1981 European Pat. Off. .
0149787 12/1984 European Pat. Off. .
2913534 10/1980 Germany ..... 417/218
3508432 9/1986 Germany .
9006444 6/1990 WIPO .
9010793 9/1990 WIPO .

*Primary Examiner*—Charles G. Freay
*Attorney, Agent, or Firm*—Flynn, Thiel, Boutell & Tanis, P.C.

[57] ABSTRACT

A pressure governor for a pump (11) employed as a variable displacement pump for supplying pressurized fluid to a hydraulic power consumer (54) is disclosed. The governor includes a differential pressure regulator (13) connected to the pump for establishing the output flow of the pump. The state of the regulator is controlled by a pressure-regulated valve (21). Valve (21) is, in its initial state, set so as to allow a high volumetric flow out of the pump. A portion of the flow out of the pump returned to the pressure regulated valve to force the valve into a second state. The movement of the valve into the second state resets the valve so that a portion of the output of the pump is applied to the pressure regulator. This flow, in turn, causes the regulator to reduce the output flow from the pump. Thus, the initial output flow of the pump is reduced so as to minimize the possibility that large sustained output flows will damage the components of the hydraulic power consumer to which the flow is applied.

18 Claims, 5 Drawing Sheets

INITIAL PRESSURE GOVERNOR FOR A VARIABLE DISPLACEMENT PUMP

FIELD OF THE INVENTION

Figure 1:
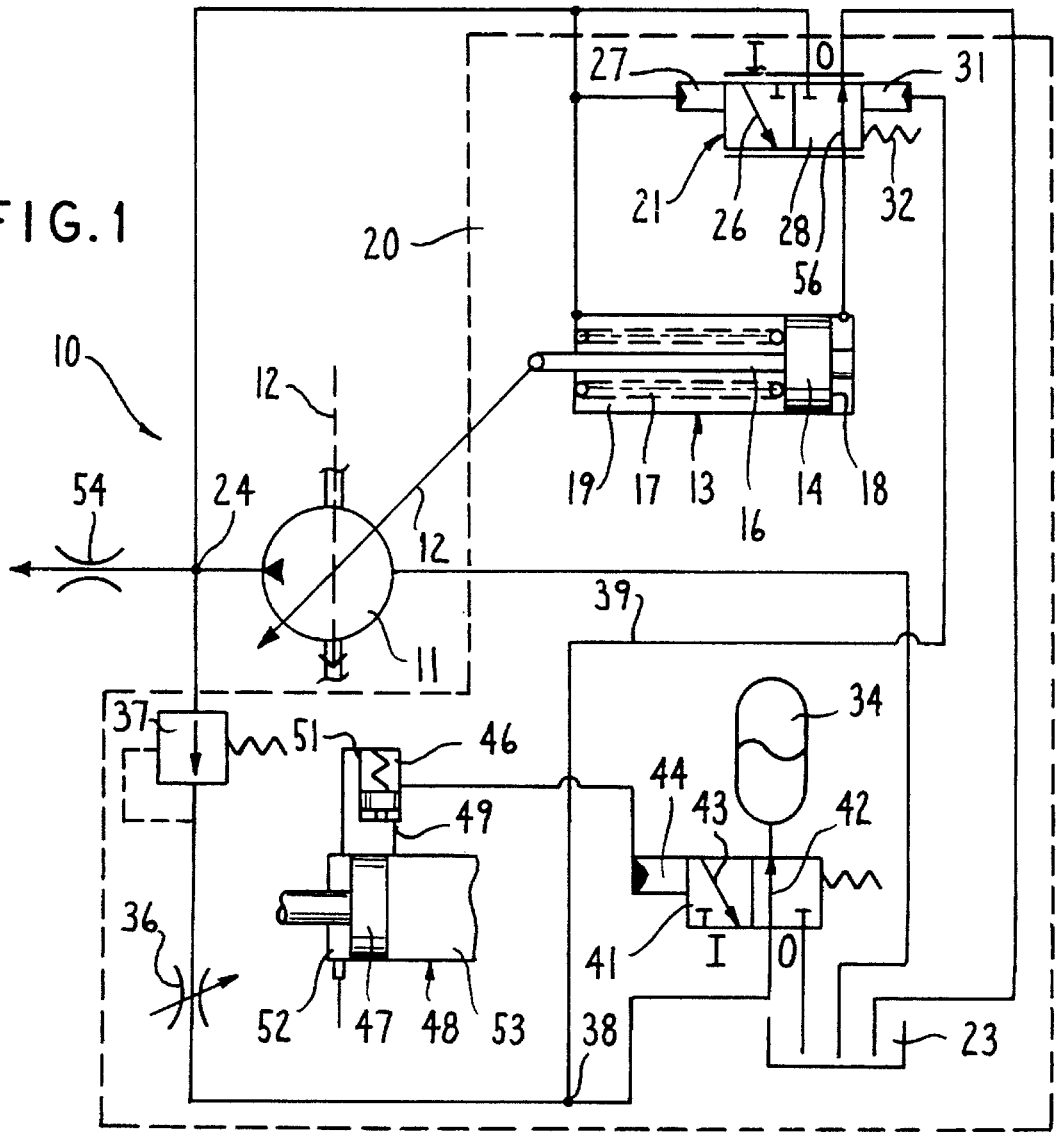

The invention relates to an initial pressure governor for a variable displacement pump, in particular to a main pump working at a high initial pressure level of a compression unit for a hydraulic driving unit, e.g. the driving cylinder(s) of a thick matter pump.

BACKGROUND OF THE INVENTION

A pressure governor is provided with a pump capacity regulator which is controllable by means of a hydraulic motor operator which can be driven by alternative pressurization and depressurization of a driving chamber for carrying out the movements for the opposite changes of the displaced volume of the variable displacement pump. Typically a pressure regulated valve is designed for controlling the pressurization and depressurization of this pressure driving chamber, which, regulated by the initial pressure of the pump or a pressure proportional to this, from a minimum pressure determined by a minimum restoring force of a restoring element, e.g. a spring, releases an initial pressure together with the control pressure coupled into its control chamber, by which the driving pressure chamber of the motor operator is pressurized.

Such pressure governors are well known. They comprise a valve driven by the initial pressure of the variable displacement pump designed, for example, as a proportional valve which, with increasing initial pressure of the variable displacement pump, is increasingly pushed against the restoring force of a valve spring into the functional position providing the activation of the actuating drive, whereby in the stationary position of the pressure control the initial pressure of the variable displacement pump is determined by the preset initial tension of the valve spring. This type of control which may be superimposed by a volume flow control, which—on a lower pressure level than the maximum level determined by the pressure regulating valve—provides a constant control of the volume flow of the high-pressure pump. It has, however, the disadvantage that in the starting situations of a hydraulic power consumer which, in the stationary position of its movements, needs a relatively high operating pressure level. Thus, strong pressure shocks may occur which promote wear and are combined with considerable noise, because in the starting situation the pressure governor is adjusted to a maximum capacity volume of the variable displacement pump which is reduced only after pumping starts. Comparable with this is also the situation that the consumer or a driving cylinder thereof is blocked, because then also the initial pressure of the variable displacement pump increases very fast—like a shock—to the value given by the pressure limit. These problems are particularly aggravating with hydraulic power consumers which are driven by linear cylinders or hydraulic oscillating motors carrying out periodic oscillating movements.

SUMMARY OF THE INVENTION

The object of the invention is to improve a control unit of the type described at the beginning in such a manner that, in particular in starting situations of a hydraulic consumer a gentle increase of the operating pressure is obtained and/or with load changes such as a sudden increase of the load a correspondingly gentle increase of the operating pressure to a given maximum value is obtained.

According to the invention, a restoring element is set to a restoring force which corresponds only to a small fraction of e.g. 1/50 to 1/10 of the control force which can be maximally generated and which acts on the valve piston of the proportional valve in that the pressure regulated valve is provided with a restoring chamber as a second control chamber, by the pressurization of which a restoring force opposite to the control force can be generated, the maximum value of which corresponds at least approximately to that of the control force, and in that the pressure coupled into the restoring chamber is derived by means of a hydraulic retarder by the pressure coupled into the control chamber of the pressure regulated valve.

Accordingly, when the hydraulic power consumer is started by switching on the compression pump, there is first an increase in pressure with a rapid increase rate of the initial pressure of the variable displacement pump until, after a time period characteristic for the hydraulic retarder and determined by the time period provided by it, it reaches a value which is higher by the pressure equivalent to the restoring force of the restoring element, in practical cases the initial tension of a valve spring, than that pressure which is coupled into the additional restoring chamber of the pressure regulated valve by the retarder. As soon as this is the case, and the control force resulting from the coupling of the initial pressure of the variable displacement pump into the control chamber of the pressure regulated valve is higher than the sum of the forces resulting from the initial spring tension and the coupling of the initial pressure of the retarder into the restoring chamber, the pressure regulated valve is directed into that functional position into which the actuating drive is driven by a reduction of the pump capacity of the variable displacement pump. Consequently, as a result the increase rate of the initial pressure of the variable displacement pump is reduced. In the "transient" state of this increasing pressure control, as opposed to the non-regulated state, the increase rate of the initial pressure of the variable displacement pump is reduced, in such a manner that the same increases with a time constant determined by the retarder, approximately linearly. Consequently, from this regulation on, the initial pressure of the variable displacement pump is always higher by the difference determined by the given restoring force of the restoring element than the pressure coupled into the restoring chamber of the pressure regulated valve by the retarder. This is also true for the case that during the operation of the consumer the same is suddenly blocked and therefore the initial pressure of the variable displacement pump increases, whereby in this case the control comes from a correspondingly increased initial pressure level.

When, as designed in the preferred embodiment of the pressure governor, the retarder comprises a throttle valve and a pressure reservoir chargeable via it, whereby the pressure developing in the operation of the consumer at the mid connection between the throttle valve and the pressure reservoir is coupled into the restoring chamber of the pressure regulated valve, the product of the flow resistance of the throttle valve and the storage capacity of the pressure reservoir is a measure for the retarding constant of the retarder, which can be set when these measurements are set, whereby it is particularly advantageous for a specific variation of the time constant of the retarder, provided its pressure reservoir has sufficient capacity, when the throttle valve of the retarder is formed as an adjustable throttle valve.

To obtain in every case a useful limitation of the initial pressure of the variable displacement pump to a maximum value of e.g. 400 bar which merely by means of the pressure regulated valve in its formation and function designed for the inventive pressure governor is alone not yet possible, it is of advantage when between the high pressure outlet of the variable displacement pump and the retarder a pressure reducer is connected which, when a threshold value of the initial pressure of the variable displacement pump is reached, prevents that a higher pressure is coupled into the retarder or the restoring chamber, respectively, of the pressure regulated valve. Consequently, with the help of the pressure governor, the maximum initial pressure of the variable displacement pump is limited to a value which corresponds to the sum of the threshold value pressure and the pressure equivalent to the initial tension of the restoring element.

When, within the scope of a complex hydraulic assembly several hydraulic power consumers are designed which are fed by means of the variable displacement pump with pressure means, which are, for example, during the course of time of periodically repeated operating cycles of the assembly "switched on" at various times and when for the activation of individual consumers only short time periods are available, it is of advantage, when the retarder can be switched off for the duration of such activation time periods, which is obtainable in the simplest case by blocking the pressure reservoir of the retarder.

A valve appropriate for this purpose is formed in the preferred embodiment of the pressure governor as 3/2-way valve, in the original position of which the pressure reservoir is connected to the throttle valve and in the control position of which the pressure reservoir is blocked against the throttle valve, but connected to the depressurized store tank of the compression unit. Therefore, the pressure reservoir can be discharged in the control position to be rechargeable in a next starting cycle and to be able to fulfill its retarding function.

For the purpose of an "undamped" control of a consumer, a valve connected between the pump outlet and the retarder can also be appropriate, which has an original position of 0 in which the pump outlet is connected to the retarder and a control position in which the pump outlet is blocked against the retarder, but directly connected to the second control chamber of the pressure regulated valve.

In combination herewith it is of advantage when between the control line to which, in the control position of the valve, the pressure outlet of the variable displacement pump is connected, and the pressure chamber of the retarder a check valve is connected, which is pressurized with a relatively higher pressure in the control line than in the pressure chamber in blocking direction to avoid in the control position of the valve that the pressure chamber is charged.

By means of a valve which is connected between the second control chamber of the pressure regulated valve and the tapping position of the retarder at which the pressure which can be coupled into this control chamber can be tapped, and from an original position 0 in which the tapping position is connected to the control chamber, which can be switched to a functional position I in which the second control chamber of the pressure regulating valve is blocked against the tapping position, but connected to the depressurized pressure reservoir of the compression unit, the pressure governor can be used to limit the initial pressure of the variable displacement pump to that value which is equivalent to the initial tension of the restoring spring of the pressure regulated valve.

The valve designed for blocking the high pressure outlet of the variable displacement pump against the retarder and the simultaneous direct connection of the pump outlet with the second control chamber of the pressure regulated valve as well as the valve utilized for pressure release of the control chamber may, each seen by itself, be designed as 3/2-way valves or realized by means of a single 4/3-way valve. And it is also understood that these valves, depending on the type of their adjusting possibilities into a hydraulic system, may be designed either as pressure regulated or as electrically controllable solenoid valves or also as valves controllable in a combination.

To be able to adjust the pressure governor in a simple manner to various operating conditions of possible consumers it is of advantage when the initial tension of the restoring valve spring of the pressure regulated valve is controllable.

The described control functions can be obtained when the pressure regulated valve is connected as a pressure regulating valve, by means of which the variable displacement pump is controllable to an—essentially—constant initial pressure and also when the pressure regulated valve is switched as a volume flow control valve, by means of which the variable displacement pump is controllable to an—essentially—constant value of its initial volume flow.

Figure 3:
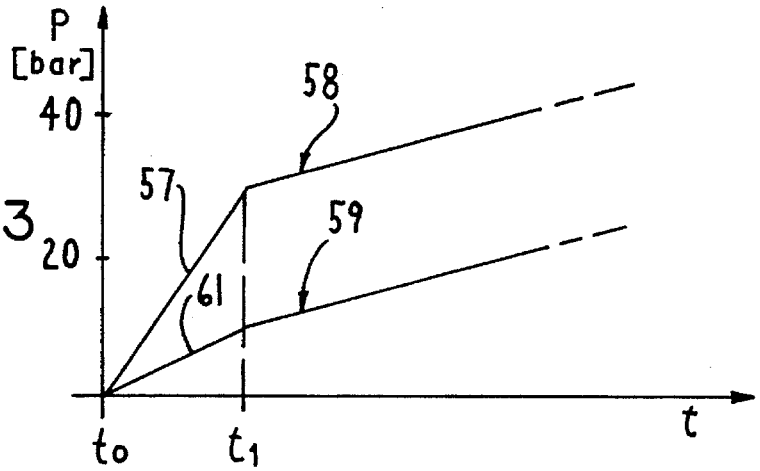
Figure 2A:
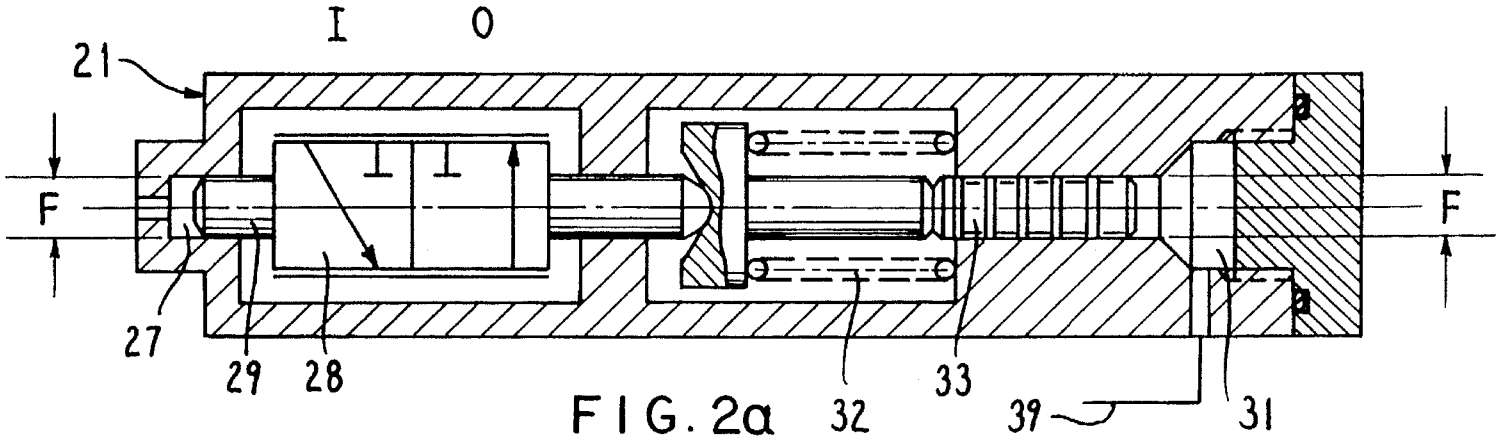
Figure 2B:
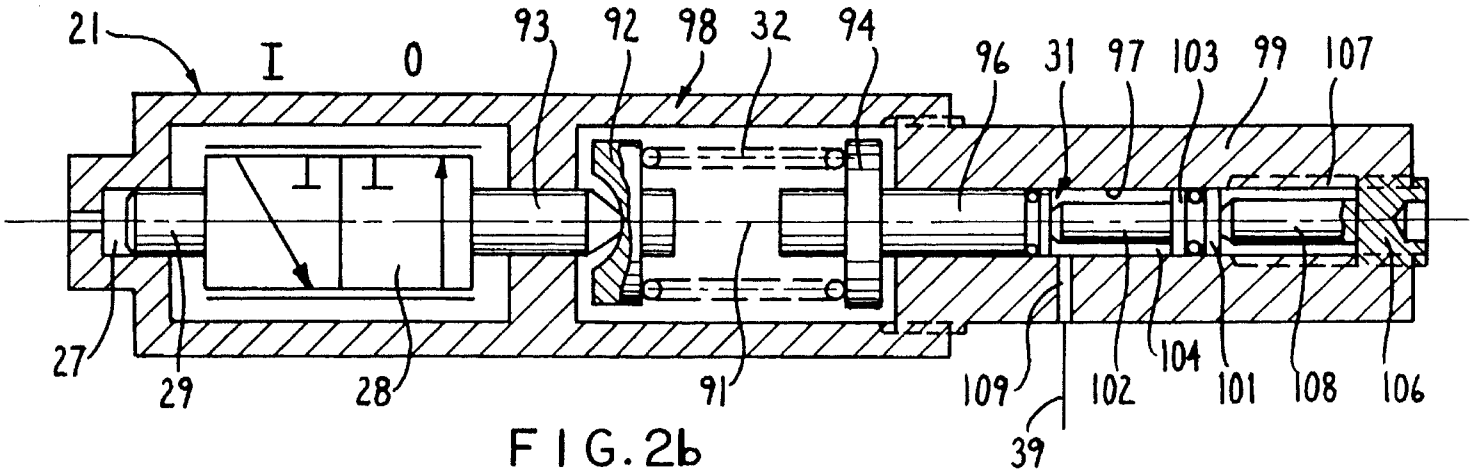
Figure 4:
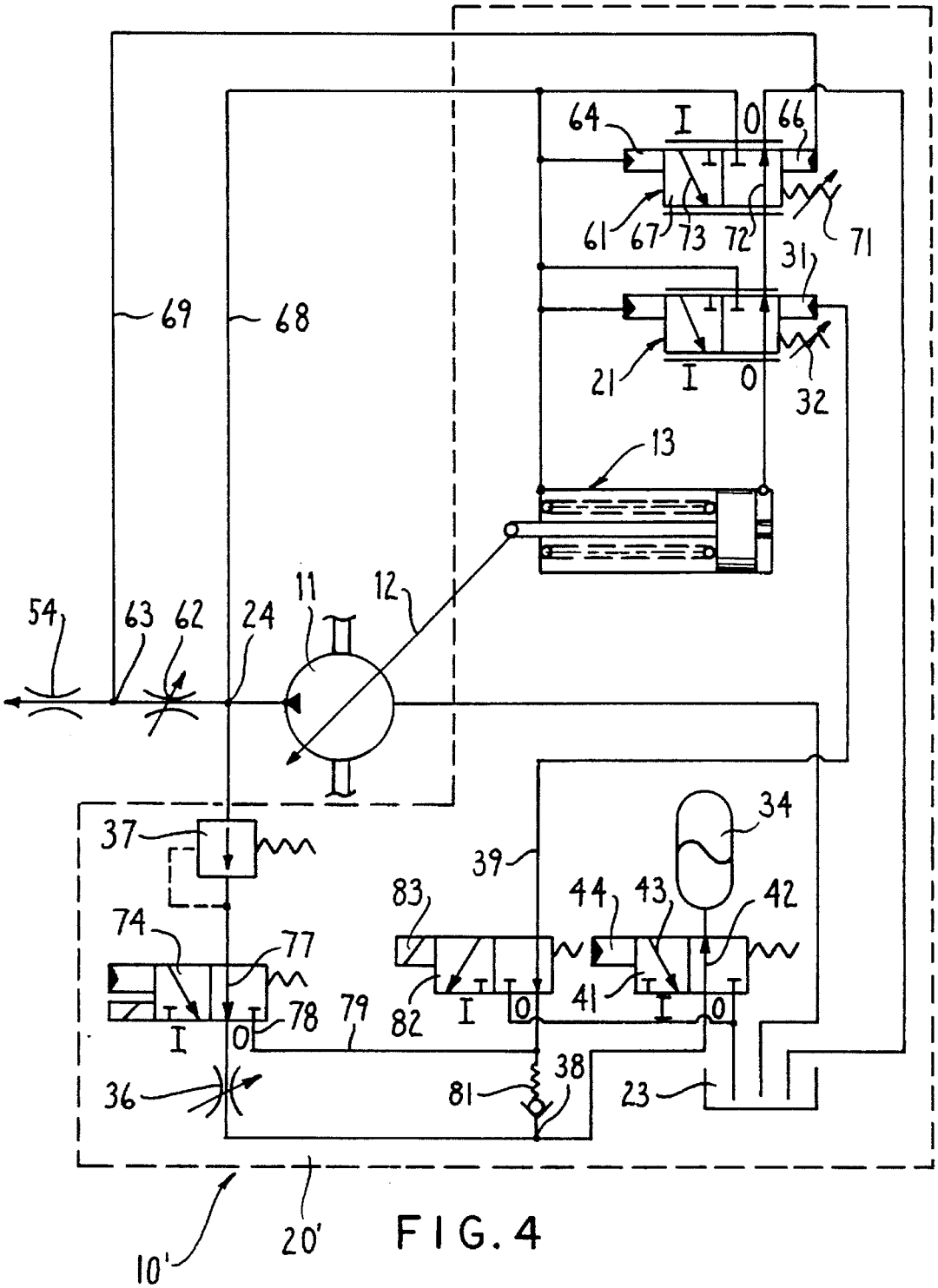
Figure 4A:
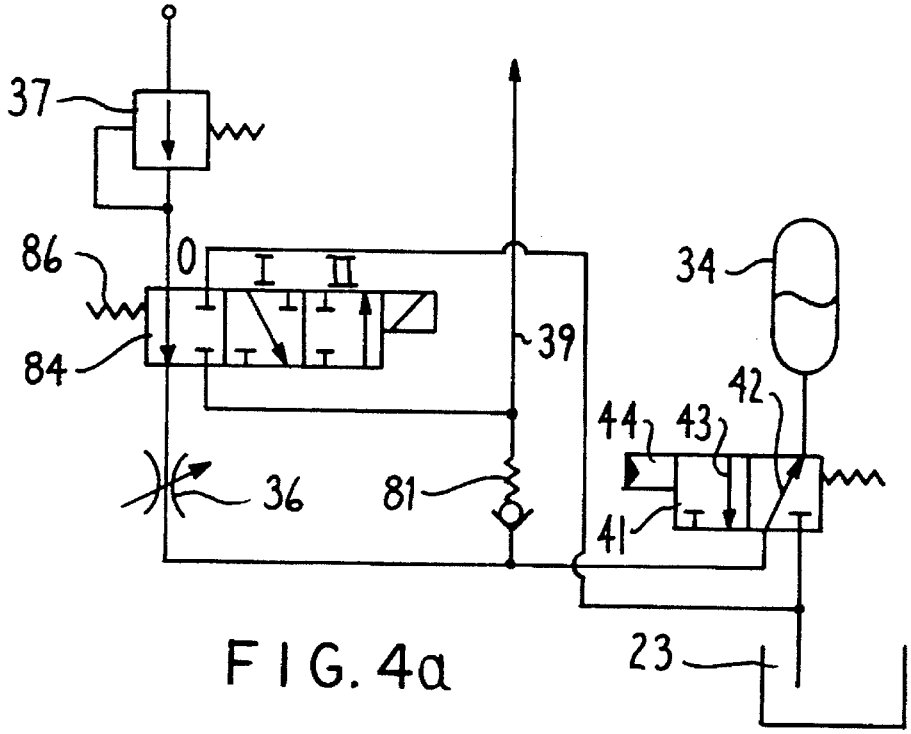
Figure 4B:
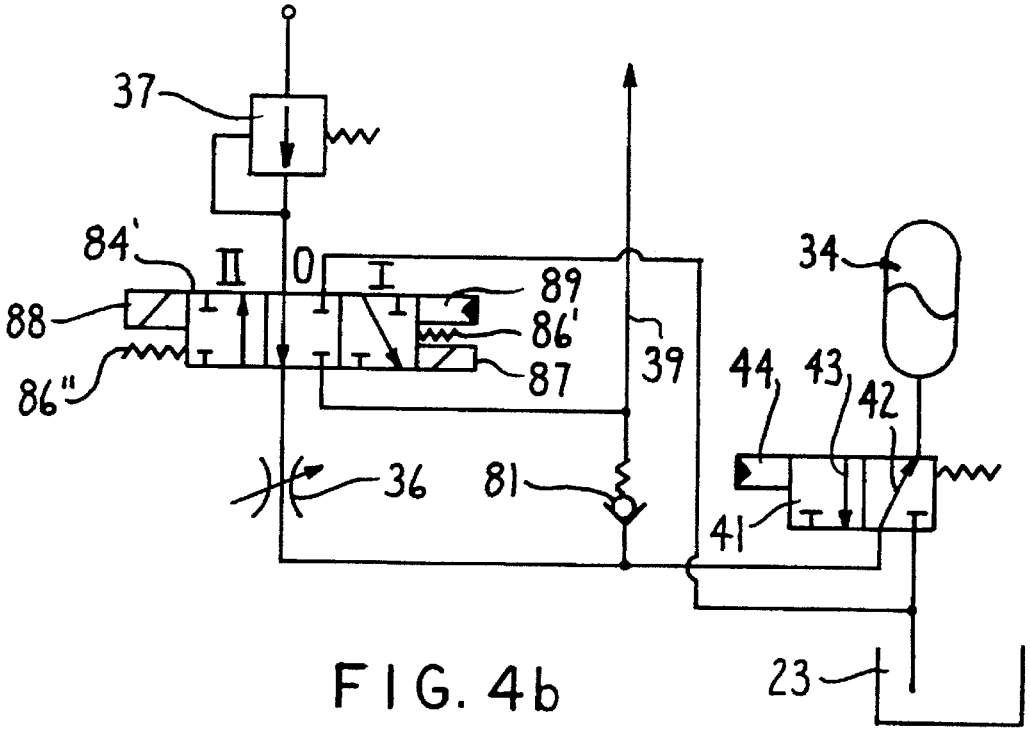
Figure 5:
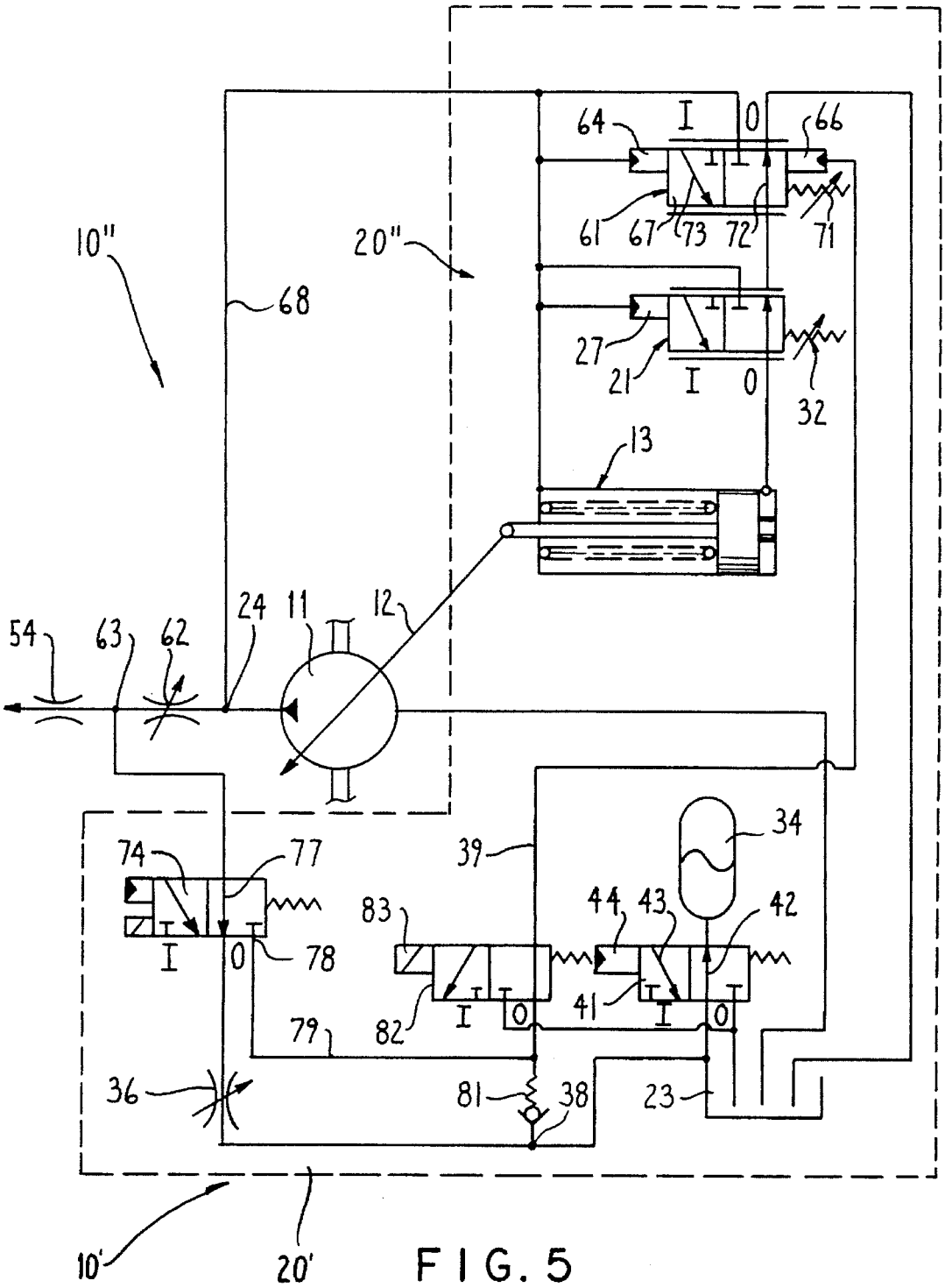

Further details and characteristic features of the invention result from the following description of particular embodiments by means of the drawing. It is shown in:

FIG. 1 a hydraulic schematic of a compression unit with a high pressure pump formed as a variable displacement pump and an inventive pressure governor for damping pressure shocks at the outlet of the variable displacement pump, FIG. 2*a* a partly schematic longitudinal section of a pressure regulating valve to be used within the scope of the pressure governor according to FIG. 1 for controlling the drive of a regulating cylinder designed for regulating the displaced volume of the variable displacement pump, FIG. 2*b* an alternative formation of a pressure regulating valve to the formation of the pressure regulating valve according to FIG. 2 with adjustable initial tension of the restoring spring, FIG. 3 a diagram for illustrating the function of the pressure governor according to FIG. 1, FIG. 4 a hydraulic schematic of another compression unit with an initial pressure control according to the invention which operates load-dependently for the main pump of the compression unit and functional control valves for occasional switching-off of the pressure control and for limiting the initial pump pressure with the cooperation of the pressure governor, FIG. 4*a* and 4*b* various embodiments of functional control valves which can be used within the scope of the pressure governor, and FIG. 5 another embodiment of an inventive pressure governor in which as a pressure regulated valve a volume flow control valve is utilized, by means of which the variable displacement pump is controllable to an—essentially—constant amount of its initial volume flow, in a representation corresponding to FIG. 1 and 4.

The compression unit shown in FIG. 1, designated as 10, is thought for use in hydraulic power consumers in which, for example, hydromotors formed as linear cylinders carry out oscillating movements which are supposed to have a lifting speed as constant as possible, whereby, when such driving cylinders are started and/or when the moving direction is reversed, pressure shocks of their pistons appearing as fast pressure increases should be damped to reduce wear and/or noise development. These requirements are generally typical for thick matter pumps, in particular concrete pumps, the driving cylinders of which are driven by high pressures of up to 400 bar.

A primary element of the compression unit 10 is a variable displacement pump 11 controllable to a constant initial pressure or also to constancy of the initial volume flow of the pressure means one such pump 11 is a rotatorily driven tilting plate axial piston pump. The pump capacity of pump 11 relates to one rotation of its not shown cylinder block is continuously changeable by changing the set angle of its tilting plate represented by arrow 12 of FIG. 1 relative to the direction of the central axes of the axial piston pump elements from zero to a maximum value $Q_{max}$. The position (shown in broken lines) of the tilting plate 12 corresponding to the displaced volume zero is the one in which its plane runs at a right angle to the central axes of the axial piston pump elements not shown of pump 11.

In the illustrated embodiment, a linear differential cylinder 13 is designed for this type of regulation of the tilting plate 12 as an actuating drive. Cylinder 13 has a piston 14 to which the tilting plate 12 is movably coupled via the piston rod 16 exiting from the casing of the differential cylinder. The assembly of the actuating drive is designed in such a manner that, when piston 14 is in the bottom-near position of its position, tilting plate 12 corresponding to its maximum displaced volume position of pump 11. The tilting plate position corresponding to the displaced volume zero of the pump corresponds to the position of its piston rod 16 which extends furthest out of the casing of the differential cylinder 13. A helical spring 17 in the differential cylinder 13 surrounds the piston rod coaxially pushes 11 piston into its bottom-near end position so that the pump 11 when started is initially adjusted to its maximum capacity. The restoring forces deriving from the helical spring 17 in the various positions of piston 14 can be neglected relative to the forces which are generated by the pressurization of the bottom-side driving chamber 18 and/or the pressurization of the rod-side driving chamber 19 of the differential cylinder 13 which act on piston 14.

Within the scope of a pressure governor designated as 20 for regulating the initial pressure of the variable displacement pump 11 a pressure regulating valve 21 for example, a proportional valve is provided. The particulars of the structural formation of valve 21 are represented in FIG. 2*a* to which it is additionally referred.

This pressure regulating valve 21 is formed as a pressure regulated sliding valve which, according to its function, is a 3/2-way valve 21 has a spring-centered original position 0 in which the bottom-side driving chamber 18 of the actuating drive cylinder 13 is connected with the depressurized, i.e. atmospheric pressure, store tank 23 and is against the high pressure outlet 24 of the variable displacement pump 11 valve 21 has a functional position I, an alternative to the original position 0, in which the bottom-near driving chamber 18 of the differential cylinder 13 is blocked against the store tank 23 and is connected via a flow path 26 of the pressure regulating valve 21 with the high pressure outlet 24 of the variable displacement pump 11. The rod-side driving chamber 19 of the differential cylinder 13 designed as actuating drive is also permanently connected to outlet 24. The pressure regulating valve 21 has a first driving chamber 27 which is also permanently connected with the high pressure outlet 24 of the variable displacement pump 11. By the pressurization of this control chamber 27 the initial pressure of the variable displacement pump 11, a control force $K_f$ pushes the valve piston 28, represented in FIG. 1 by the 3/2-way switch symbol, into its functional position I. The amount of the control force $K_f$ is essentially given by the product $P_A(t).f$, whereby with $P_A(t)$ the instantaneous value of the initial pressure of the variable displacement pump 11 is designated and with f the cross-sectional area of the piston end flange 29 of the valve piston 28 forming the one-side axially movable boundary of the first control chamber 27.

Furthermore, the pressure regulating valve 21 has a second control chamber 31. The pressurization of chamber 31 occurs as a result of an equidirectional restoring force permanently exerted by the valve spring 32 in the chamber and an additional restoring force $K_0$ adding to it. Collectively, these forces are exerted onto the valve piston 28, by which the piston is pushed into its end position corresponding to the functional position 0 of the pressure regulating valve 21.

The amount of force $K_0$ is given by the product $P_a(t).f$, whereby with $P_a(t)$ the instantaneous value of the pressure coupled into the second control chamber 31 is designated and with f the cross-sectional area of a regulating piston element 33 forming the one-side axially movable boundary of the second control chamber 31, the effective cross-sectional area f of which is equivalent to that of the piston end flange 29 which forms the axially movable boundary of the first control chamber 27.

Furthermore, within pressure governor 20 a pressure reservoir 34 is designed. Reservoir 34 is chargeable by means of a volume flow regulator, for example a regulating throttle 36, to a pressure the maximum value Pamax which is controllably set by a pressure reducer or limiter 37. Limiter 37 is represented in this embodiment as being connected between the regulating throttle 36 and the high pressure outlet 24 of the variable displacement pump 11.

The pressure $P_a(t)$ at the mid connection 38 between the regulating throttle 36 and the pressure reservoir 34 is coupled via a control line 39 to the second control chamber 31 of the pressure regulating valve 21.

Between the mid connection 38 and the pressure reservoir 34, a cyclically controllable retarding control valve 41 formed as 3/2-way valve is connected. Valve 41 has a spring-centered original position 0 in which the pressure reservoir 34 is connected via a flow path 42 open in this original position 0 to the mid connection 38 and via the regulating valve 36 and the pressure reducer 37 to the high pressure outlet 24 of the variable displacement pump 11. Valve 41 has an alternative functional position I, in which the pressure reservoir 34 is blocked against the mid connection 38, but connected via a flow path 43 open in the functional position I with the depressurized store tank 23 of the compression unit 10.

Here, "cyclically controllable" means that the retarding control valve 41 is appropriately switched in a synchronized manner with the various operating phases of the consumer connected to the compression unit 10 between the two functional positions 0 and I. This controls the low or high pressure increase rates at the pressure outlet 24 of the variable displacement pump 11 which are favorable for operating the consumer.

With the embodiment shown in FIG. 1, the retarding control valve 41 is formed as a pressure regulated valve. As long as a pressure impulse is coupled into a valve control chamber 44 lasts, valve 41 is switched into its functional position I connecting the reservoir 34 with the store tank 23. This pressure impulse to valve 41 is generated by a hydraulic end position transmitter 46 formed as a one-way or check valve and used when the driving piston 47 of a hydraulic driving cylinder 48 of the consumer, for example, of a two-cylinder thick matter pump with a tubular points switch not shown reaches near its represented end position. When piston 47 is in this position, the lift of the lifting cylinder driven with this driving cylinder 48 of the thick matter pump is blocked and decreases after a switching of the pressurization of the driving cylinder 48 from bottom-side to rod-side pressurization, i.e. switching of the lifting cylinder driven by this driving cylinder 48 to loading operation, the driving piston 47 is again pushed back from its represented end position. Consequently, the control inlet 49 and the reference inlet 51 of the hydraulic end position transmitter 46 return to the same pressure level which is at the rod-side driving pressure chamber 52 of the driving cylinder 48. The piston 47 moves in the direction of its bottom-side end position when the bottom-side driving pressure chamber 53 is depressurized. For that, an additional end position transmitter may be designed which, when it reaches this end position, also generates an initial pressure signal, by the means of which the retarding control valve 41 can be controlled in the same manner.

The compression unit 10, the assembly of which has been illustrated, operates in typical operation situations of a consumer shown in FIG. 1 by a flow resistance 54 connected between the high pressure outlet 24 of the variable displacement pump 11 and the store tank 23 of the compression unit 10, for example as follows.

I. Starting Operation

In a starting situation, in which by switching on the variable displacement pump 11, the compression unit 10 and the consumer connected to it is operated, it is presumed that the pressure reducer 37 is adjusted to a defined upper pressure limit $P_{amax}$ of, for example 200 bar and that the pressure reservoir 34 is, for example, completely discharged to a minimum pressure. The regulating throttle 36 is also adjusted to a flow resistance which in combination with the designed formation of the pressure reservoir 34 results in a desired retarding time t, at which the pressure $P_a(t)$ developed at the mid connection 38 is coupled into the second control chamber 31 of the pressure regulating valve 21 via the control line 39. After the variable displacement pump 11 is switched on, the initial pressure $P_A(t)$ developing at its high pressure outlet 24 follows in a time-delayed manner. Furthermore, it is presumed that the lifting cylinder(s) of a thick matter pump designed as a consumer are filled so that, when the pump is started, the inertial and frictional forces caused by the material to be conveyed are effective. The pressure regulating valve 21 is when the control chambers 27 and 31 are depressurized, because of the initial tension of the valve spring 32, in its original position 0 valve spring 32 is further designed in such a manner and its initial tension is adjusted in such a manner that it is equivalent to a control pressure of, for example, 20 bar, i.e., corresponds to a small fraction of approximately 1/20 to 1/10 of the maximum initial pressure $P_A$ of the variable displacement pump 11. The bottom-side driving chamber 18 of the actuating drive 13 is thus depressurized via the flow path 56 cleared in the original position 0 of the pressure regulating valve 21. Thus variable displacement pump 11 is preset by the effect of the restoring spring 17 of the actuating drive 13 to an operation with maximum volume flow.

When in this starting situation, the variable displacement pump 11, for example at time $t_0$, is switched on. Because the pump 11 operates with maximum volume flow, but the initial pressure is not yet sufficient to get the pump driving cylinders 48 started, a very fast pressure increase results which is represented in the diagram of FIG. 3. The first, steeply rising branch 57 of the continuous curve designated as $P_A(t)$, represents qualitatively the time period of the pressure $P_A(t)$ at the high pressure outlet 24 of the variable displacement pump 11. This pressure increase is accompanied by a "slower" pressure increase of the pressure $P_a(t)$ which can be tapped at the mid connection 38 of the retarder formed by the regulating throttle 36 and the pressure reservoir 34, the time period of which is represented qualitatively in the diagram of FIG. 3 by the $P_a(t)$ continuous curve 59.

Eventually, the difference between the initial pressure $P_A(t)$ released at the high pressure outlet 24 of the variable displacement pump 11 at time $t_1$ coupled into the first control chamber 27 of the pressure regulating valve 21, and the more slowly increasing pressure $P_a(t)$ which is opposed to it, tapped from the mid connection 38 of the retarder 36, 34 coupled into the second control chamber 31 of the pressure regulating valve 21 reaches a valve greater than the initial tension of valve spring 32 imposes a pressure regulating valve 21. Valve 21 is then pushed into its functional position I in which the initial pressure $P_A(t)$ of the variable displacement pump 11 is coupled into the bottom-side driving chamber 18 of the actuating drive 13. This pressure displaces piston 14 so as to actuate tilting plate 12 which, in turn, reduces the volumetric output of pump 11.

The reduction in output from pump 11 at time $t_1$ on, in its "oscillating"—stationary state, the time increase rate $\Delta P_A(t)/\Delta t$, that is the increase of the $P_A(t)$ continuous curve 58 for the time period following the time $t_1$ is decreased to a value which corresponds at the most to the increase rate $\Delta P_a(t)/\Delta t$ of the $P_a(t)$ continuous curve 59 in its initial area 61 between the times $t_0$ and $t_1$. This rate is distinctly lower than the pressure increase rate of the initial pressure $P_A(t)$ Of the variable displacement pump 11 immediately after the same is started, i.e. in the area between the time $t_0$ and $t_1$ represented by the first increasing branch 57 of the $P_A(t)$ continuous curve, whereby the initial pressure $P_A(t)$ of the variable displacement pump 11 is always higher by the pressure difference corresponding to the initial tension of the valve spring 32 of the pressure regulating valve 21 of, for example, 20 bar than the pressure which can be tapped at the tapping position 38 of the retarder 36, 34, which corresponds to the pressure to which the pressure reservoir 34 is charged at the respective time.

When the pressure reservoir 34 is designed and the flow resistance of the regulating throttle 36 is adjusted in an appropriate manner, then the hydraulic consumer fed by means of the compression unit 10 can be easily started in a "gentle" manner.

II. Periodic Operation of the Consumer

By the switch turned on in the end positions of piston 47 of the driving cylinder 48 by a pressure impulse initial signal of the respective hydraulic end position transmitter 46 of the retarding control valve 41 and the discharge of the pressure reservoir 34 connected with it. Consequently, immediately before the moving direction of the piston 47 of the driving cylinder 48 is reversed, essentially the same conditions are obtained as in the above-described starting operation. While here the pressure reservoir 34 is discharged, a gentle starting of the pressure governor 20 of the variable displacement pump 11 is ineffective. This time period can, for example, be utilized with a two-cylinder thick matter pump with a tube switch control for regulating the drive of a driving cylinder for the tube switch, because this switching operation should be very fast. Therefore, retarding such switching is not necessary, even concerning a gentle starting.

III. Blocking Load

When during a stationary operation situation of the compression unit 10, i.e. when an operation phase of load 54 in which the initial pressure of the variable displacement pump 11 is constant, and its initial volume flow and the pressure to which the pressure reservoir 34 is charged, corresponds to the initial pressure of the variable displacement pump 11, the load may suddenly increase. This may occur due to the blocking of the thick matter pump or one of its driving cylinders, because then the pressure at the high pressure outlet 24 of the variable displacement pump 11 increases faster than at the mid connection 38 of the retarder 36, 34, causes the pressure regulating valve 21 to react and the displaced volume of the variable displacement pump 11 to be reduced, the initial pressure of which now increases analogously "slowly" controlled to the starting situation, until the upper limit of the same is reached, which is higher by the pressure difference equivalent to the initial tension of the valve spring 32 than the limiting value $P_{amax}$ to which the pressure reducer 37 is adjusted.

For describing further embodiments of the compression unit 10 which are useful in combination with the pressure governor 20 for a multiple use of the compression unit 10, it is now referred to FIG. 4.

Structural and functional elements of the compression units 10 and 10' represented in FIG. 1 and 4 having the same reference numerals refer to the structural and functional equality or analogy of these elements and regarding the embodiment represented in FIG. 4 to the description given in FIG. 1 of elements designated as such.

In the compression unit 10' according to FIG. 4, a volume flow control valve 61 is further provided within the scope of the pressure governor 20' valve 61 controls the initial volume flow of the variable displacement pump 11 is controllable to a value necessary for the operation of the consumer 54 by adjusting a set value regulator 62.

The set value regulator 62 is designed as a regulating throttle and is coupled between the high pressure outlet 24 of the variable displacement pump 11 and the consumer 54 connected to the compression unit 10'. The pressure difference during the course of the operation of the consumer 54 between its operation pressure feeding connection 63 and the high pressure outlet 24 of the variable displacement pump 11 represents an exact measure for the volume flow pushed through the regulating throttle 62 which senses this pressure difference.

The volume flow control valve 61 is designed as a structural analogy to the pressure regulating valve 21 as a pressure regulated 3/2-way proportional valve. Valve 61 has a first control chamber 64 and a second control chamber 66 by the pressurization of which opposite regulating and restoring forces can be exerted onto the valve piston represented by the 3/2-way valve symbol 67. These control chambers 64 and 66 are again designed in such a manner that in a pressurization of the two control chambers with equivalent pressures, the resulting forces on the valve piston 67 would be equalized.

The first control chamber 64 of the volume flow control valve 61 is connected via a control line 68 to the high pressure outlet 24 of the variable displacement pump 11. The second control chamber 66 of the volume flow control valve 61 is connected to the feeding connection 63 of the consumer 54 via an additional control line 69.

By a valve spring 71, the initial tension of which is adjustable, and also by pressurization of the second control chamber 66 volume flow control valve 61 is forced into its original position 0. The regulating force resulting from a pressurization of the first control chamber 64 with the high initial pressure $P_A(t)$ of the variable displacement pump 11 forces the valve piston 67 of the volume flow control valve 61 into its functional position I.

The volume flow control valve 61 has a flow path 72 open in its original position 0, via which, when the pressure regulating valve 21 is simultaneously in its original position 0, the bottom-side driving chamber 18 of the actuating drive cylinder 13 is connected with the depressurized store tank 23 of the compression unit. Valve 61 has a flow path 73 cleared in its functional position I, via which likewise, when the pressure regulating valve 21 is in its original position 0, the initial pressure released at the high pressure outlet 24 of the variable displacement pump 11 is coupled into the bottom-side driving chamber 18 of the regulating cylinder 13. The application of this pressure results in the displacement of piston 14 and plate 12, which, in turn, reduces the displaced volume of the variable displacement pump 11.

Whenever the pressure difference appearing above the set value regulator 62 becomes bigger than a value set by the initial tension of the valve spring 71 of the volume flow control valve 61, the outlet volume flow of the variable displacement pump 11 is reduced. Pump 11 output volume is increased if this pressure differences becomes smaller than the amount determined by the initial tension of the valve spring 71, which has a typical value of approximately 20 bar.

To be able to occasionally switch off the effect of the retarder 36, 34 damping a very fast pressure increase at the high pressure outlet 24 of the variable displacement pump 11, for example, to be able to regulate an additional, not represented, hydraulic consumer without time delay, a functional control valve 74 is connected between the pressure reducer 37 and the retarder 36, 34, as designed in the embodiment according to FIG. 4.

This functional control valve 74 is designed as 3/2-way valve having a spring-centered original position 0, in which the pressure outlet 76 of the pressure reducer 37 is connected to the regulating throttle 36 of the retarder 36, 34 via a flow path 77 of the functional control valve 74, but blocked against a second outlet connection 78 of the functional control valve 74. Connection 78 is connected via a by-pass line 79 with the control line 39, via which the pressure is coupled into the second control chamber 31 of the pressure regulating valve 21. This functional control valve 74 is hydraulically and/or electrically switchable into a functional position I, in which the pressure outlet 76 of the pressure reducer 37 is blocked against the regulating throttle 36 of the retarder 36, 34, but connected with the by-pass line 79. Between the mid connection 38 of the retarder 36, 34 and the by-pass line 79 or the control line 39 leading to the second control chamber 31 of the pressure regulating valve 21, a check valve 81 is connected. Valve 81 is kept in its blocking position by the relatively higher pressure in the by-pass line 79 or the control line 39, respectively, than at the mid connection 38 of the retarder 36, 34 and pressurized by a relatively higher pressure in the open direction at the mid connection 38 than in the control line 39. This check valve 81 prevents that in the functional position I of the functional control valve 74 the pressure means can be received by the pressure reservoir 34. This has the effect that the pressure means is "directly" directed to the second control chamber 31 of the pressure regulating valve 21 to keep it securely in its original position 0, in which the bottom-side driving chamber 18 of the regulating cylinder 13 is depressurized and, therefore, the variable displacement pump 11 is set to a maximum displaced volume.

Furthermore, within the scope of the pressure governor 20' according to FIG. 4, a release valve 82 represented as 3/2-way solenoid valve is designed. Valve 82 has a spring-centered original position 0 in which the regulating pressure is coupled into the second control chamber 31 of the pressure regulating valve 21 either via the check valve 81 or directly. Additionally, valve 82 has a flow position as an alternative functional position I when its control solenoid 83 is regulated by a control signal. This flow position, in which the control chamber 31 of the pressure regulating valve 21 is connected with the, depressurized, store tank 23 of the compression unit 10', against which, however, the control line 39 connected to the check valve 81 or directly at the mid connection 38 of the retarder 36, 34 is blocked.

In this excited position I of release valve 82, the initial pressure of the variable displacement pump 11 is practically limited to the lower value to which the optionally adjustable initial tension of the valve spring 32 of the pressure regulating valve 21 is equivalent.

In particular, the release valve 82 is suitable for protecting the compression unit 10' against overload when the consumer is blocked.

Instead of the two 3/2-way valves 74 and 82 which are designed in the embodiment according to FIG. 4 as a functional control valve and as a release valve, as shown in the switching variants according to FIG. 4*a* and 4*b*, one single 4/3-way valve 84 (FIG. 4*a*) or 84' (FIG. 4*b*) can be used within the scope of the pressure governor 20' as shown in FIG. 4.

The 4/3-way valve 84 according to FIG. 4*a* is exclusively designed as an electrically controllable solenoid valve which can be switched by control signals of various currents $I_1$ of, for example 3A and $I_2$ of, for example, 6A. This switching moves valve 84 from its initial spring-centered position 0, in which the increasing retarding control of the initial pressure of the variable displacement pump 11 is effective, into a functional position I, in which this control is switched off. Alternatively, valve 84 can be switched into a functional position II in which the control line 39 to the second control chamber 31 of the pressure regulating valve 21 is connected to the store tank 23. Therefore, as a result of this latter switching, the initial pressure of the variable displacement pump 11 is limited to the lower level of, for example, 20 bar equivalent to the initial tension of the valve spring 32 of the pressure regulating valve 21.

While in the 4/3-way valve 4 according to FIG. 4*a* only a valve spring 86 is designed, against the increasing restoring force of which the valve 84 has to be regulated into its functional position I and II, whereby the original position 0 of this valve is a "boundary position" in the 4/3-way valve 84' according to FIG. 4*b* two oppositely operating valve springs 86' and 86" are designed, which center the valve piston of this 4/3-way valve 84' in a mid position, which here is designed as original position 0. Accordingly, two control solenoids 87 and 88 are also designed, by the alternative control of which the 4/3-way solenoid valve 84' is controllable in its functional position I or II, respectively, which functionally correspond to the functional positions I and II of the solenoid valve 84 according to FIG. 4*a* designated accordingly. As opposed to this, the 4/3-way valve 84' according to FIG. 4*b* can be switched "directly" from its original position 0 into the functional position II, without the functional position I having to be overrun. Alternatively or additionally to the control solenoid 87, by the excitation of which the 4/3-way valve 84' according to FIG. 4*b* can be switched into its functional position I, a hydraulic control can also be designed, as illustrated by a control chamber 89, by the pressurization of which, for example, occurring simultaneously with the hydraulic control of the retarding control valve 41 the 4/3-way valve 84' is switchable into its functional position.

Moreover, the structural and functional elements shown in FIG. 4*a* and 4*b* provided with the same reference numerals as elements of this Fig. illustrated by FIG. 1 and 4, with reference to FIG. 4*a* and 4*b*, refer to the structural and functional equality or analogy, respectively, of the elements designated identically and also to their explanation given in FIG. 1 and 4.

Additionally, by means of FIG. 2*b*, a particular formation of a pressure regulating valve 21 to be used within the scope of the pressure governors 20 and 20' is described, in which the initial tension of the valve spring 32, by the initial tension of which the minimum value of the initial pressure of the variable displacement pump 11 is determined, is controllable.

The valve spring 32 pushes the valve piston 28 shown only schematically by the 3/2-way valve symbol into the original position 0 of the pressure regulating valve 21, seen along the central longitudinal axis 91 of the pressure regulating valve 21. Spring 32 clamped between a first support plate 92 engaging axially into a ram-shaped extension 93 of the valve piston 28 and a second support plate 94 which has at its side opposite to the valve spring 32 a control piston extension 96, with which slides in an axial boring 97 of a control casing element 99, which is screwed into the valve casing 98.

Inside this axial boring 97, a control piston element 101 is designed in such a manner that it can be slid keeping the pressure inside, which is axially supported at the control piston extension of the second spring support plate 94 with the slim, ram-shaped extension 102, the diameter of which is smaller than the diameter of the axial control casing boring 97. The second control chamber 31 is formed axially by the chamber 104 extending in axial direction between the control piston extension 96 of the second support plate 94 and the sealing flange 103 of the control piston element 101. The initial tension of the valve spring 32 can be adjusted by means of an adjusting screw 106 which can be screwed in a thread portion 107 of the control casing element 99 which is supported by the control piston element 101 by means of an axial ram-like extension 108.

The axial guiding sides of the control piston extension 96, of the control piston element 101 as well as the thread portion 107 and the arrangement of the control chamber connection channel 109 to which the control line 39 is connected are adjusted to one another in such a manner that within the possible heights of the movable elements of the control chamber connection channel always opens into the control chamber 31 and a variation of the spring tension as far as possible can be utilized.

Now, as an explanation of another embodiment which corresponds structurally and functionally largely to the embodiment according to FIG. 4, it is referred to FIG. 5.

Structural and functional elements of the represented compression unit 10' in FIG. 5 comprising the same reference numerals as the structural and functional elements of the compression unit 10' according to FIG. 4 refer to the structural and functional analogy of such elements and also to their description given in FIG. 4. Therefore, the illustration of the compression unit 10" and its pressure governor 20" can be limited to the illustration of the differences as opposed to the embodiment in FIG. 4.

The pressure which is coupled into the retarder by the regulating throttle 36 and the pressure reservoir 34 formed in combination with the retarding control valve 44 is tapped at the operating pressure feeding connection 63, forming at the mid connection between the consumer 54 and the regulating throttle between them and the high pressure outlet 24 of the variable displacement pump 11 as set value regulator 62. Valve 62 is designed as volume flow sensor for the flow control by means of the volume flow control valve 61, which is utilized in the embodiment according to FIG. 5 for pressure control, for example, in the starting operation of the variable displacement pump 11. Accordingly, the pressure $P_a(t)$ developing at the mid connection 38 between the regulating valve 36 and the pressure reservoir 34 is coupled via the control line 39 into the second control chamber 66 of the volume control valve 61. Consequently, the restoring force working against the regulating force resulting from a pressurization of the first control chamber 64 of the volume flow control valve with the high initial pressure $P_A(t)$ of the variable displacement pump and pushing the valve piston 67 of the volume flow control valve 61 into its functional position I, corresponds to the restoring force resulting from the sum of the restoring force generated by the restoring spring 71 and the pressurization of the second control chamber 66 with the initial pressure $P_a(t)$ which follows the initial pressure $P_A(t)$ in a time-delayed manner.

In the pressure regulating valve 21 only the valve spring 32 is designed as the restoring element pushing it into its original position 0, the initial tension of which can be regulated. In a typical formation of the pressure regulating valve 21, the initial tension of its valve spring 32 is adjustable to values which are equivalent to pressures between 50 bar and 400 bar. Consequently, in a typical formation of the volume flow control valve 61 the initial tension of its valve spring 71 is adjustable to values which are equivalent to pressures between 10 bar and 30 bar. The function of the compression unit 10" according to FIG. 5, concerning the starting operation, is completely equivalent to that of the compression units 10 and 10' according to FIG. 1 and 4, the periodic operation of the consumer as well as the behavior when there is a blocking load.

In the compression unit 10" an element corresponding to the pressure reducer 37 of the compression units 10 and 10' according to FIG. 1 and 4, having only this function, is not necessary.

The embodiments of the invention in which an exclusive property or privilege is claimed are defined as follows:

1. A pressure governor for regulating the output of a hydraulic displacement pump that generates a pressurized fluid to a hydraulic fluid consuming unit, the pump including an outlet through which the pressurized fluid is discharged and an actuatable control plate for regulating the output of the pump, the control plate having a first position allowing maximum pump output and a second position allowing a minimum pump output, said governor comprising:

a differential-pressure actuated regulator connected to the pump control plate for moving the control plate between the first and second positions, said regulator having opposed first and second chambers, wherein when fluid in said first chamber is pressurized relative to fluid in said second chamber, said regulator moves the pump control plate to the first position and when fluid in said second chamber is pressurized relative to fluid in said first chamber, said regulator moves the pump control plate to the second position;

a conduit connecting the outlet of the pump to said first chamber of said regulator;

a pressure regulated valve, said pressure regulated valve being connected to the outlet of the pump and said second chamber of said regulator, said pressure regulated valve having:

a valve unit having a first position for connecting said second chamber of said regulator to a discharge port and a second position for connecting the outlet of the pump to said second chamber of said regulator;

a biasing member connected to said valve unit for holding said valve unit in said first position;

a first control chamber connected to the outlet of the pump and to said valve unit wherein, when said first control chamber is provided with pressurized fluid from the outlet of the pump, said valve unit is displaced to said second position so as to allow fluid flow from the pump into said second chamber of said regulator; and a second control chamber for receiving a restoring fluid wherein, when the restoring fluid is applied to said second control chamber, the pressure of the restoring fluid and said biasing member urge said valve unit from said second position to said first position; and a hydraulic retarder connected between the outlet of the pump and said second control chamber of said pressure regulated valve for supplying pressurized fluid from the pump to said second control chamber as the restoring fluid, wherein said hydraulic retarder is configured to supply the pressurized fluid to said second control chamber at a pressure that increases at a rate slower than the rate at which the pressure of the fluid discharged from the pump increases.

2. The pressure governor of claim 1, wherein said hydraulic retarder includes: a throttle connected to receive the pressurized fluid from the pump; and a pressure reservoir connected to receive fluid from said throttle wherein the restoring fluid is supplied from said hydraulic retarder to said second control chamber of said pressure regulated valve from a mid-connection point located between said throttle and said pressure reservoir.

3. The pressure governor according to claim 2, wherein said hydraulic retarder throttle is a regulating throttle.

4. The pressure governor of claim 2, wherein said hydraulic retarder includes a valve located between said throttle and said pressure reservoir wherein said valve is configured to selectively connect said pressure reservoir to either said throttle or to a low-pressure discharge port.

5. The pressure governor according to claim 2, further including a pressure limiter located between the outlet of the pump and said throttle of said hydraulic retarder, said pressure limiter being configured to establish a maximum pressure of fluid applied to said hydraulic retarder.

6. The pressure governor according to claim 5, further including a first valve connected to said hydraulic retarder before said throttle and to said second control chamber of said pressure regulated valve so that said flow from said pressure limiter can selectively be applied directly to said second control chamber of said pressure regulated valve as the restoring fluid.

7. The pressure governor according to claim 6, further including a pressure limiter located between the pump outlet and said hydraulic retarder, said pressure limiter being configured to establish a maximum pressure of fluid applied to said hydraulic retarder.

8. The pressure governor of claim 6, further including a second valve located between said mid-connection point and said pressure tank, said second valve functioning as a relief valve having a first position for connecting said pressure reservoir to said throttle and a second position for connecting said pressure reservoir to a discharge port.

9. The pressure governor of claim 8, wherein said second valve is provided with a biasing member for holding said second valve in said first position, and said second valve is further provided with a position sensor connected to the hydraulic fluid consuming unit, said position sensor being configured to move said second valve into said second position during a selected portion of the use cycle of the pressurized fluid by the hydraulic fluid consuming unit.

10. A pressure governor for regulating the output of a hydraulic displacement pump that generates a pressurized fluid to a hydraulic power consumer, the pump including an outlet through which the pressurized fluid is discharged and an actuatable control plate for regulating the output of the pump, the control plate having a first position allowing maximum pump output and a second position allowing a minimum pump output, said governor comprising:

a differential pressure actuated regulator connected to the control plate of the pump for moving the control plate between the first and second positions, said regulator having opposed first and second chambers, wherein when fluid in said first chamber is pressurized relative to fluid in said second chamber, said regulator moves the control plate of the pump to the first position and when fluid in said second chamber is pressurized relative to fluid in said first chamber, said regulator moves the control plate of the pump to the second position;

a set valve regulating throttle located between the outlet of the pump and the hydraulic power consumer, said set valve regulating throttle being configured to establish a pressure difference between the fluid discharged at the outlet of the pump and the fluid applied to the hydraulic power consumer;

a conduit connecting the pump outlet to said regulator first chamber;

a first pressure regulated valve, said first pressure regulated valve being connected to the outlet of the pump and said second chamber of said regulator, said first pressure regulated valve having:

a valve unit having a first position for opening said second chamber of said regulator and a second position for connecting the outlet of the pump to said second chamber of said regulator;

a biasing member connected to said valve unit for holding said valve unit in said first position;

a first control chamber connected to the outlet of the pump and to said valve unit wherein, when said first control chamber is provided with pressurized fluid from the outlet of the pump, said valve unit is displaced to said second position; and a second control chamber for receiving a restoring fluid wherein, when the restoring fluid is applied to said second control chamber, the pressure of the restoring fluid and said biasing member urge said valve unit from said second position to said first position;

a second pressure regulated valve, said second pressure regulated valve being connected to the outlet of the pump, to said set valve regulating throttle and to said second chamber of said regulator when said second chamber of said regulator is opened by said first pressure regulated valve, said second pressure regulated valve having:

a valve unit having a first position for establishing a discharge path from said second chamber of said regulator to a low-pressure discharge port and a second position for connecting the outlet of said pump to said second chamber of said regulator;

a biasing member connected to said valve unit for holding said valve unit in said first position;

a first control chamber connected to the outlet of the pump and to said valve unit wherein, when said first control chamber is provided with a pressurized fluid from the outlet of the pump, said valve unit is displaced to said second position; and a second control chamber for receiving a resetting fluid from said set valve regulating throttle wherein, when the resetting fluid is applied to said second control chamber, said pressure of the resetting fluid and said biasing member urge said valve unit from said second position to said first position; and a hydraulic retarder connected between the outlet of the pump and said second control chamber of said first pressure regulated valve for supplying pressurized fluid from the pump to said second control chamber of said first pressure regulated valve as the restoring fluid wherein, said hydraulic retarder is configured to supply the pressurized fluid to said second control chamber at a pressure that increases at a rate slower than the rate at which the pressure of the fluid discharged from the pump increases.

11. The pressure governor of claim 10, wherein said hydraulic retarder includes: a throttle connected to receive the pressurized fluid from the pump; and a pressure reservoir connected to receive fluid flow from said throttle wherein the pressurized fluid is supplied from said hydraulic retarder to said second control chamber of said first pressure regulated valve from a mid-connection point located between said throttle and said pressure reservoir.

12. The pressure governor according to claim 11, wherein said hydraulic retarder throttle is a regulating throttle.

13. The pressure governor of claim 11, further including a valve located between said throttle and said pressure reservoir wherein said valve is configured to selectively connect said pressure reservoir to either said throttle or to a low-pressure discharge port.

14. The pressure governor according to claim 11, further including a pressure limiter located between the outlet of the pump and said throttle, said pressure limiter being configured to establish a maximum pressure of fluid applied to said hydraulic retarder.

15. The pressure governor according to claim 14, further including a by-pass valve connected to said hydraulic retarder before said throttle of said hydraulic retarder and to said second control chamber of said first pressure regulated valve so that said flow from said pressure limiter can selectively be applied directly to said second control chamber of said first pressure regulated valve as the restoring fluid.

16. The pressure governor according to claim 15, wherein said by-pass valve is a three position valve having a first position for supplying fluid from the outlet of the pump to said hydraulic retarder throttle, a second position connecting fluid flow from the outlet of the pump to said second control chamber of said first pressure regulated valve and a third position connecting said second control chamber of said first pressure regulated valve to a low-pressure discharge port.

17. The pressure governor according to claim 15, further including a vent valve connected between said by-pass valve and said second control chamber of said first pressure regulated valve for selectively connecting said second control chamber of said first pressure regulated valve to said bypass valve or to a low-pressure discharge port.

18. The pressure governor of claim 10 wherein said biasing member of said first pressure regulated valve is configured to place an adjustable force on said valve unit of said first pressure regulated valve and said biasing member of said second pressure regulated valve is configured to place an adjustable biasing force on said valve unit of said second pressure regulated valve.

* * * * *